United States Patent [19]

Zezza

[11] Patent Number: 4,727,987

[45] Date of Patent: Mar. 1, 1988

[54] GARMENT RETAINING APPARATUS

[75] Inventor: Carlo Zezza, Annapolis, Md.

[73] Assignee: Delsey Luggage Company, Jessup, Md.

[21] Appl. No.: 831,919

[22] Filed: Feb. 21, 1986

[51] Int. Cl.[4] ..... A45C 5/12; A45C 13/30

[52] U.S. Cl. ..... 206/293; 206/287; 206/289; 206/292; 190/13 C; 190/36

[58] Field of Search ..... 206/287, 287.1, 289, 206/293, 291, 292; 190/13 C, 36

[56] References Cited

U.S. PATENT DOCUMENTS

| | | | |
|---|---|---|---|
| Re. 18,415 | 4/1932 | Hamlin | 206/292 |
| 838,621 | 12/1906 | Hawley et al. | 190/13 C |
| 1,228,732 | 6/1917 | Adams | 206/293 X |
| 1,389,595 | 9/1921 | Phillips | 190/13 C |
| 1,455,063 | 5/1923 | Batts | 190/13 C X |
| 1,827,542 | 10/1931 | Ritter, Jr. | 206/292 |
| 1,901,395 | 3/1933 | Cheney | 190/13 C X |
| 1,960,454 | 5/1934 | Ritter, Jr. | 206/292 |
| 2,028,339 | 1/1936 | Levine et al. | 206/292 |
| 3,139,164 | 6/1964 | Koffler | 206/287.1 X |
| 3,512,621 | 5/1970 | Teetor | 206/287 |

FOREIGN PATENT DOCUMENTS

| | | | |
|---|---|---|---|
| 667652 | 11/1938 | Fed. Rep. of Germany | 206/289 |
| 904909 | 9/1962 | United Kingdom | 206/291 |

*Primary Examiner*—William Price
*Assistant Examiner*—Sue A. Weaver
*Attorney, Agent, or Firm*—Finnegan, Henderson, Farabow, Garrett & Dunner

[57] ABSTRACT

An apparatus for retaining garments securely in place within a folding garment bag and on respective hangers includes a pair of straps forming "suspenders" diagonally across the garments and a second pair of straps forming a "belt" horizontally thereacross. The diagonal suspenders encircle the garment and, in conjunction with elasticized supports extending from the top of the garment bag, maintain the garment in place on their respective hangers.

8 Claims, 3 Drawing Figures

GARMENT RETAINING APPARATUS

BACKGROUND OF THE INVENTION

1. Field of the Invention

The invention relates to garment bags and, in particular, to an apparatus for maintaining clothes on respective hangers within a folding garment bag.

2. Description of the Prior Art

Folding garment bags provide a convenient means for carrying clothes, particularly coats, jackets, suits and the like. For purposes of packing, a garment bag is typically unfolded and, for example, conveniently supported on a closet rod or door in order to place the garments within the bag. Generally the garments are first placed on hangers individually and the hangers are then attached to the upper end portion of the garment bag. The bag can then be closed and folded about its midline to ease carrying.

Garment bags of this type come in various sizes, including a "standard length" which is approximately the length of conventional suits and jackets. When garments of that type are stored in a standard length bag and the bag is folded in half, the midline of the bag corresponds substantially with the midline of the clothing. Thus, the garments are folded substantially in their middle and are balanced to either side. This balance maintains the garments in place on their respective hangers within the bag during transit or other handling.

"Long length" garment bags are also known, in which the bag is relatively longer than the garments contained therein. Such a garment bag can be used to conveniently carry an overcoat or other long outerwear; however, innerwear, such as suits and jackets, are considerably shorter than the overall length of the bag. When folded, therefore, the midline of the bag does not correspond to the middle of such shorter garments. This creates a lack of equilibrium, and the shorter garments tend to slip out of position during transit of the folded bag. Typically, the shorter garments slip down towards their shoulder portions and become loose around their respective hangers. When the bag subsequently is hung up and opened, the garments are discovered to have fallen off their respective hangers altogether.

A problem therefore exists with respect to securely maintaining garments in place in a folding garment bag, especially longer bags.

SUMMARY OF THE INVENTION

An object of the present invention, therefore, is an apparatus for securely retaining garments within a folding bag.

Another object of the invention is to secure garments within a folding bag especially where there is a disparity in the relative lengths of the garment and bags.

A further object of the invention is to provide garment retaining means for a folding bag which do not interfere with placing garments within the bag or securing the retaining means.

Further objects of the present invention will become apparent from the full description of the invention and drawings as set forth below.

According to the present invention, a bag for garments disposed on respective hangers is provided, the bag having two major opposing sides joined by a top end portion and by two side portions, the garments being disposed in the bag with their respective hangers proximate the top end portion, the bag comprising: a pair of support means coupled to the top end portion and disposed on either side of the hangers; a pair of connecting rings coupled to the two side portions, each of the connecting rings being individually coupled to a respective one of the two side portions; and means coupled between the pair of support means and the pair of connecting rings for retaining the garments within the bag, the retaining means encircling the garments and maintaining the garments on their respective hangers.

The accompanying drawings, which are incorporated in and constitute a part of the specification, illustrate the presently preferred embodiments of the invention and, together with the description, serve to explain the principles of the invention.

DETAILED DESCRIPTION OF THE PREFERRED EMBODIMENTS

Figure 1:
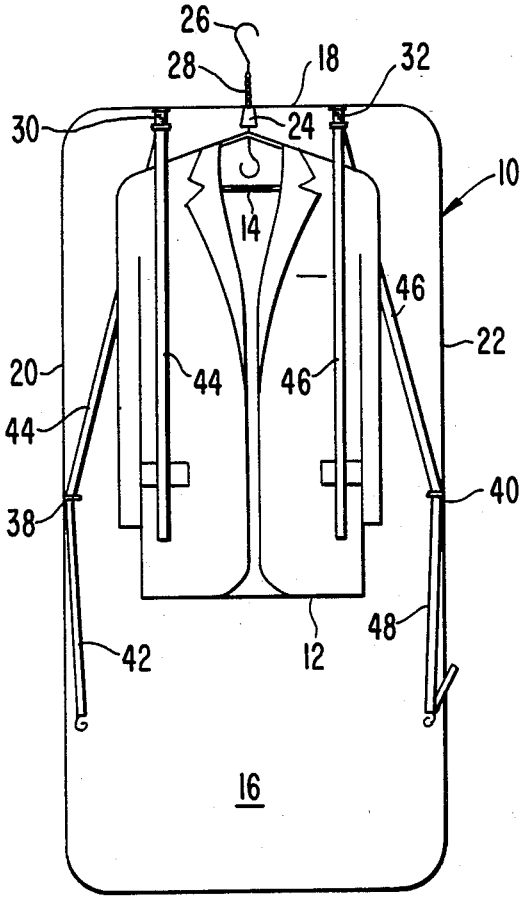
FIG. 1 is a front plan view of a garment bag including a retaining apparatus according to the present invention, in which the retaining apparatus is unlocked.

The present invention will now be described beginning with reference to FIG. 1.

Reference numeral 10 generally denotes a folding garment bag in which garments, such as a jacket 12, are maintained on respective hangers 14. In known fashion, garment bag 10 has two major opposing sides, the rear major side being designated generally by reference character 16. The front major side (not shown) has been opened to provide access to jacket 12. The garment bag further includes a top end portion 18 and side portions 20, 22 joining the two major opposing sides.

Within garment bag 10, garments such as jacket 12 are maintained with their respective hangers 14 proximate the top end portion 18 of the bag. To facilitate this arrangement, it is known to provide a coupler 24 for coupling hanger 14 to top end portion 18 of the garment bag. Coupler 24 may be a simple metal loop over which the hook of hanger 14 is disposed or may comprise more complex arrangements, such as snap-closured loops or the like. The outer side of top end portion 18, i.e. the outside of the garment bag, may also be provided with a hook 26 and chain 28 for conveniently hanging the garment bag from a closet rod or the like during packing and unpacking of clothes. Garment bags having such features are known in the art and need not be described further for purposes of understanding the present invention.

Figure 3:
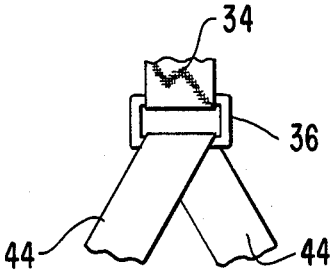
FIG. 3 is a detail view showing one of the support means of the retaining apparatus of FIGS. 1 and 2.

In accordance with the invention, a pair of support means are provided coupled to the top end portion and disposed on either side of the hangers. As embodied herein, the pair of support means are designated by reference characters 30, 32 and extend from the internal surface of top end portion 18 of garment bag 10. As shown in partial view in FIG. 3, the support means preferably comprises an elasticized portion 34 coupled at one end (not shown in FIG. 3) to top end portion 18. A supporting loop 36 is fastened at one end of portion 34, such as by doubling the elasticized portion 34 thereover and fastening it back on itself. A similar arrangement is provided for support means 30 and 32, i.e. an elasticized portion coupled to a supporting loop. The purpose and function of this arrangement will be better understood from the following description.

Also according to the invention, a pair of connecting rings are provided coupled to the two side portions, each of said connecting rings being individually coupled to a respective one of the two side portions. As embodied herein, the pair of connecting rings are designated by reference characters 38, 40 in FIG. 1. Rings 38, 40 may comprise a ring or other closure, such as a U-shaped partial loop, affixed to side portions 20, 22 respectively. Means for providing a fixture so that rings 38, 40 are suitably secure are known in the art.

In accordance with the invention, means are provided coupled between the pair of support means and the pair of connecting rings for retaining the garments within the bag, the retaining means encircling the garments and maintaining them on their respective hangers. As embodied herein, the retaining means are generally designated by reference characters 42, 44, 46 and 48 in FIG. 1. The retaining means preferably comprise fabric such as nylon or canvas straps, or other suitable material, and are coupled to support means 30, 32 and connecting rings 38, 40 within garment bag 10.

More specifically, straps 42 and 48 together provide horizontal restraining action, i.e. a "belt" for retaining garment 12 in place. Strap 42 is securedly coupled to connecting ring 38 disposed on side portion 20, whereas strap 48 is securedly coupled to connecting ring 40 disposed on side 22. Straps 44 and 46 together function to provide diagonal retaining of garment 12, i.e. a "suspenders" arrangement for maintaining the garment within bag 10. Strap 44 has a first end securedly coupled to connecting ring 38, and is supported proximate the top end portion 18 of the bag via support means 30. More specifically, this is accomplished by strap 44 passing through loop 36 of support means 30, as shown in detail in FIG. 3. The other end of strap 44, in the position shown in FIG. 1, hangs freely in front of garment 12. Strap 46 is correspondingly affixed to connecting ring 40 of side 22 and threaded through a similar loop provided in support means 32.

Figure 2:
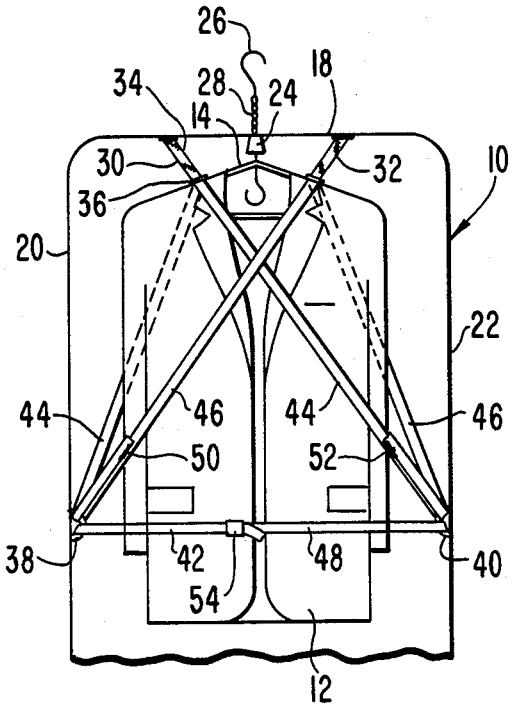
FIG. 2 is the retaining apparatus of FIG. 1 in a locked, i.e. closed, position.

While FIG. 1 shows the inventive retaining apparatus in an open or unlocked position, FIG. 2 illustrates use of the retaining apparatus. In FIG. 2, similar reference characters are used to designate identical elements already depicted in FIGS. 1 and 3.

Having placed a garment 12 in position within bag 10 as described previously, the inventive retaining apparatus is utilized by appropriately fastening straps 42, 44, 46 and 48. This is done by positioning the free end of strap 44 so as to couple with connecting ring 40 of side 22, while the free end of strap 46 is positioned to couple with connecting ring 38 of side 20. Preferably, this is accomplished by threading the free ends of straps 44 and 46 through respective connecting rings 38, 40.

Next, the free ends of straps 44, 46, having been threaded through the side connecting rings, are tensioned such that support means 30, 32 extend from top end portion 18 towards the shoulder region of garment 12 on hanger 14. Referring to support means 30 in FIG. 2, for example, this tensioning corresponds to an extending of elastic portion 34 so that loop 36 comes to rest upon the shoulder of garment 12 directly atop hanger 14. A similar tensioning is accomplished with respect to support means 32. Having tensioned straps 44, 46 in this manner, the straps are then fixed in place through self-holding means, such as Velcro, hook and eye closure, buckles or the like. Such arrangements are generally designated by reference characters 50, 52 in FIG. 2.

The belt portion of the retaining means is utilized by joining straps 42 and 48 via a buckle 54 or other similar closure arrangement. Closure devices suitable for use with straps 42, 44, 46 and 48 are known in the art and can be used interchangeably without departing from the spirit or scope of the present invention.

Retention of garment 12 within bag 10 is accomplished via several mechanisms. Notably, the garment is encaptured and encircled via the positions of straps 44 and 46. Tensioning of the straps thus serves to secure garment 12 without need for pressing the garment against one of the major opposing sides of garment bag 10. The inventive retaining means therefore function equally well whether a single garment or numerous garments are packed in the bag.

Another feature of the subject retaining means is that tensioning of straps 44, 46 in combination with the elasticized movement of support means 30, 32 serves to firmly maintain the garments in their proper place on their respect hangers 14. That is, strap 44 and support means 30, as well as strap 46 and support means 32, exert a downward tension at the shoulder of garment 12 which is counteracted by hanger 14 being maintained in place by coupler 24. Hanger 14 is therefore held in place and garment 12 is securely held thereon even when the bag is folded.

Lastly, the belt formed by straps 42 and 48 also serves to keep garment 12 in place within the bag. Preferably straps 42 and 48 are disposed approximately at the midline of bag 10, i.e. the line along which folding occurs. In such an arrangement, the belt serves to keep the garment in place together with the aforedescribed features.

From the structures described above, it can be appreciated that the present invention provides a retaining apparatus for securely holding garments within a folding bag. Accordingly, the garments do not suffer from the problems of the prior art devices, namely, slipping off their respective hangers while the folded bag is in transit. The disclosed apparatus is further advantageous in that it does not block or hinder placement of garments within the bag or their removal since, during such times, (as shown in FIG. 1), the free ends of the various straps can easily be moved. Additionally, since the apparatus chiefly utilizes fabric strap material or the like, it does not add undesirable weight or structure to the folding garment bag.

Various modifications in the inventive apparatus may be made without departing from the spirit or scope of the claimed invention. As disclosed previously, various closure methods may be employed with respect to fasteners 50, 52 and 54. Another modification is providing straps 42 and 44 as a unitary strap, with straps 46 and 48 likewise being a unitary piece. In such an arrangement, unitary straps 42, 44 would merely slip through connecting ring 38 rather than being coupled thereto, and unitary straps 46, 48 would likewise be maintained by ring 40 although not coupled thereto. When closing the straps in the manner illustrated in FIG. 2, such a modification would permit tension from the belt region (straps 42, 48) to be passed onto the suspender region (straps 44, 46), and vice versa.

Inasmuch as the present invention is subject to many such variations, modifications and changes in detail, it is intended that all matter contained in the foregoing description or shown in the accompanying drawings shall be interpreted as illustrative and not in a limiting sense. Accordingly, it should be evident to those skilled in the art that minor variations may be made in the disclosed embodiments without departing from the spirit and scope of the invention.

What is claimed is:

1. A bag for garments disposed on respective hangers, the bag having two major opposing sides joined by a top end portion and by two side portions, the bag being disposed to retain garments therein with their respective hangers proximate the top end portion, the bag comprising:

a pair of support means coupled to the top end portion and disposed on either side of the hangers;

a pair of connecting rings coupled to the two side portions, each of said connecting rings being individually coupled to a respective one of the two side portions; and means coupled between said pair of support means and said pair of connecting rings for retaining the garments within the bag, said retaining means encircling the garments and maintaining the garments on their respective hangers by compressing the garments against the hangers, said retaining means comprising a pair of straps, each strap serially being (a) coupled to a respective one of said connecting rings, (b) disposed in back of said garments, (c) coupled to the nearer one of said support means, (d) disposed in front of said support means, and (e) coupled to the other one of said connecting rings.

2. The garment bag as claimed in claim 1 wherein said retaining means further includes a belt coupled to said pair of connecting rings and disposed across the garments.

3. The garment bag as claimed in claim 2 wherein said belt is integrally formed with said pair of straps.

4. The garment bag as claimed in claim 1 wherein said support means are elastically coupled to said top end portion, said straps being tensioned so as to draw said support means substantially into contact with the garments.

5. The garment bag as claimed in claim 4 wherein each of said support means comprises a supporting loop coupled to an elastic strip extending from the top end portion, said pair of straps individually passing through respective ones of said supporting loops and being tensioned so as to draw said supporting loops substantially into contact with the garments.

6. An apparatus for retaining garments in a bag, the bag having two major opposing sides joined by a top end portion and by two side portions, the bag being disposed to retain garments therein on respective hangers proximate the top end portion, the apparatus comprising:

a pair of first rings coupled to the top end portion and being disposed on either side of the hangers;

a pair of second rings coupled to the two side portions, each of said second rings being individually coupled to a respective one of the two side portions;

a first strap having one end secured to one of said second rings, said first strap being serially disposed (1) diagonally across the garments, (2) through one of said first rings, (3) behind the garments, and (4) through the other one of said second rings, said first strap having a second end extending from said other one of said second rings and being disposed transversley across the garments; and a second strap having one end secured to said other one of said second rings, said second strap being serially disposed (1) diagonally across the garments, (2) through the other one of said first rings, (3) behind the garments, and (4) through said one of said second rings, said second strap having a second end extending from said one of said second rings and being disposed transversley across the garments, the second ends of said first and second straps being coupled together so as to maintain the garments in place within the bag.

7. The garment retaining apparatus as recited in claim 6, wherein said first strap is securedly coupled to said other one of said second rings and said second strap is securedly coupled to said one of said second rings.

8. The garment retaining apparatus as recited in claim 6, wherein said pair of first rings are each coupled by means of an elastic material to the top end portion of the bag.

* * * * *